US005207199A

United States Patent [19]

Sekiguchi

[11] Patent Number: 5,207,199

[45] Date of Patent: May 4, 1993

[54] ELECTRONIC FUEL-INJECTION DEVICE HAVING READ/WRITE MEMORY FOR STORING ACTUATOR CORRECTION VALUE

[75] Inventor: Akira Sekiguchi, Konan, Japan

[73] Assignee: Zexel Corporation, Tokyo, Japan

[21] Appl. No.: 957,789

[22] Filed: Oct. 8, 1992

[30] Foreign Application Priority Data

Oct. 9, 1991 [JP] Japan ..... 3-290893

[51] Int. Cl.[5] ..... F02D 31/00

[52] U.S. Cl. ..... 123/357; 123/449

[58] Field of Search ..... 123/357, 358, 359, 494, 123/449

[56] References Cited

U.S. PATENT DOCUMENTS 4,294,211 10/1981 Stumpp ..... 123/357
4,497,294 2/1985 Izumi ..... 123/357
4,572,130 2/1986 Tsukamoto ..... 123/357
4,667,634 5/1987 Matsumura ..... 123/357
4,961,412 10/1990 Furuyama ..... 123/357

*Primary Examiner*—Carl S. Miller
*Attorney, Agent, or Firm*—Wenderoth, Lind & Ponack

[57] ABSTRACT

A fuel injection device includes an actuator for positioning an adjusting member to establish a fuel injection level. A correcting device such as a resistor is provided to compensate for any positional deviation of the adjusting member during assembly of the fuel injection device. A value of the correcting device is read and compared with an actuator correction value previously stored in a read/write memory such as an E²PROM. If the value of the correcting device is within normal parameters and differs from the prestored actuator correction value, the prestored actuator correction value is overwritten using the value of the correcting device to obtain a new stored actuator correction value. The actuator correction value stored in the read/write memory is used to correct the position of the adjusting member.

15 Claims, 9 Drawing Sheets

Table

| VRQ | RQ |
|---|---|
| VRQ 1 | RQ 1 |
| VRQ 2 | RQ 2 |
| ⋮ | ⋮ |
| VRQ 12 | RQ 12 |
| VRQ 13 | RQ 13 |

ELECTRONIC FUEL-INJECTION DEVICE HAVING READ/WRITE MEMORY FOR STORING ACTUATOR CORRECTION VALUE

BACKGROUND OF THE INVENTION

1. Field of the Invention

This invention pertains to an electronically controlled fuel injection device, and more particularly, to a fuel injection pump controlled by an electronic control unit.

2. Description of the Related Art

A fuel injection pump typically includes an adjusting member for establishing the level of fuel-injection. This adjusting member forms part of an actuator which is activated by signals from a control unit.

Once a target position of the adjusting member is computed by the control unit according to the needs of the engine, the operational level of the actuator is determined to conform the position of the adjusting member to the target position. The aforementioned actuator is secured to the pump with a bolt, and if the actuator is not secured to the pump at an exactly appropriate position, the desired level of fuel injection is not attained.

Therefore, when assembling the fuel-injection pump, prior to tightening the bolt which secures the actuator to the pump, it is necessary to shift the position of the actuator relative to that of the pump to determine the best possible position of the actuator, that is a position in which the desired injection characteristics will be attained.

In the past, the present inventor has proposed the following idea. In order to simplify the task of positioning the actuator relative to the pump, the actuator is first tentatively secured to the pump at a position within a roughly prescribed parameter, a difference between a reference (desired) injection level and an actual injection level is then measured with a pump tester by driving the fuel injection pump through a specific number of rotations, and then an adjustment resistor (Q adjustment resistor) having a resistance value corresponding to this difference is then installed on the fuel-injection pump to correct the difference between the actual injection characteristics and the desired injection characteristics of the fuel-injection pump.

The following similar method is disclosed in Japanese Kokai Patent Publication H2-21594. Data denoting a Q adjustment resistor installed in a fuel-injection pump is read and stored in a memory every time the pump is activated. The data stored in the memory is read to correct those actual fuel injection characteristics of the pump which deviate from desired characteristics. If the Q adjustment resistor operation malfunctions for any reason, an average standard correction value, which has been preliminarily determined as back-up data, is input to the memory. The subsequent control of the fuel injection pump is carried out on the basis of this data.

According to the latter method the actuator is roughly positioned and secured to the pump at such position. Subsequently, the injection characteristics of the pump are minutely adjusted using a Q adjustment resistor. Initially, however, the actual injection characteristics will vastly differ from the reference injection characteristics (the injection characteristics required by engine conditions), since the actuator is only roughly positioned when secured to the pump. Therefore, if the Q resistor does not work, and the back-up data must be utilized, and the difference between the actual and desired injection levels can be as inaccurate as that occurring upon the initial rough positioning of the actuator on the pump. Accordingly, this latter method suffers a drawback in that a large difference can exist between the desired corrected characteristic data of the pump and the back-up data, and thus accurate control of the injection level is impossible when the Q resistor malfunctions.

Additionally, it may be necessary to replace the Q adjustment resistor by trial and error to adjust the actual injection characteristics to agree with desired injection characteristics. Therefore, it is necessary to use a resistor that has a mechanism to correct injection characteristics of the pump according to the required value, every time the Q adjustment resistor is replaced.

SUMMARY OF THE INVENTION

A primary goal of the present invention is to provide an electronic fuel-injection device which operates with a high degree of accuracy by taking the actual injection characteristics of a pump of the device into account when its Q adjustment resistor issues an abnormal input, and in which its Q adjustment resistor is replaceable.

In one preferred example of the invention, as shown in FIG. 1, the electronic fuel-injection device of the present invention comprises: a fuel-injection pump 1 having a pump body, an adjusting member the position of which establishes the fuel injection level of the pump, and an actuator secured to the pump body and operatively connected to said adjusting member so as to drive the same; correcting device 29, secured to the exterior of pump storing a correction, represented by a physical quantity and indicative of a difference between the reference (desired) injection level and the actual injection level of the aforementioned fuel-injection pump 1; readable and writable memory means 100 for storing data corresponding to the physical quantity in the aforementioned correcting device 29; input-judging means 200 for judging a normality or abnormality of a signal-input of the aforementioned correcting device 29; data-judging means 300 for judging whether the data corresponding to the physical quantity stored in correcting device 29 as data, is equal to the data stored in the aforementioned memory means 100; overwriting means 400 for overwriting the physical quantity previously generated by the correcting device 29 and stored as data in the aforementioned memory means 100, when the physical quantity of the correcting device 29 is judged as normal by the input-judging means 200, but is further judged as different from the data in the memory means 100 by the data-judging means 300; correcting means 500 for correcting, at regular time intervals, the difference between the characteristics of the aforementioned fuel-injection pump 1, based on the data in the aforementioned memory means 100.

Simply put, the fuel-injection pump 1 is controlled as follows: input-judging means 200 checks the signal input of the correction device 29; if the signal input is abnormal, correcting means 500 corrects it, by reading the physical quantity of the correcting device 29 secured to pump 1 stored as data in memory means 100.

It is possible to make a correction by reading the data stored in memory means 100, even when the signal-input from correcting device 29 is normal. However, in order to cope with a situation where the physical quantity is altered by replacement of the correcting device 29, data-judging means 300 judges whether the data corresponding to the physical quantity has been changed in the new correcting device 29, and if it is changed, overwriting means 400 overwrites the data in memory means 100 into data representative of the physical quantity of the new correcting device 29.

According to the present invention, it is thus possible to read data from the memory means corresponding to the physical quantity of the correcting device connected to the fuel-injection pump, regardless of a normality or abnormality of the correcting device's signal input, and to correct the differences between desired and actual fuel injection level characteristics based on the data read from the memory means. Therefore, the correction can be made considering the pump's unique characteristics, which helps in ensuring accurate corrections. When the physical quantity of the correcting device is changed, the data corresponding thereto and stored in memory means 100 is overwritten if the signal-input of the correcting device is normal. The subsequent corrections are made on the basis of the new data, which is convenient for the case when the correcting device needs to be changed while the pump is adjusted.

BRIEF DESCRIPTION OF THE DRAWINGS

Many other advantages, features and objects of the present invention will be understood by those of ordinary skill in the art referring to the attached drawings, which illustrate a preferred embodiment of the present invention, and in which.

Figure 9:
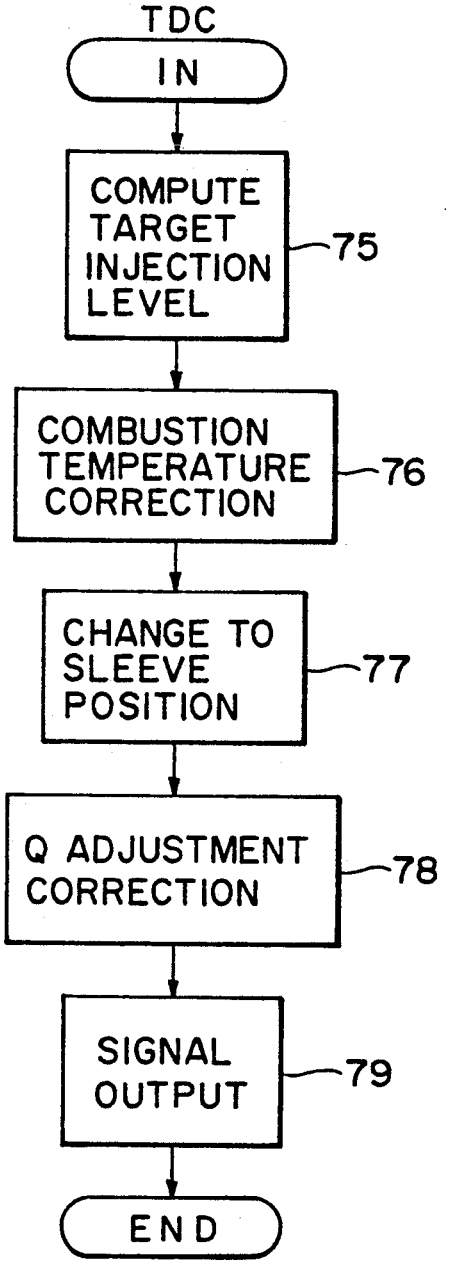
FIG. 9 is a flow chart of an operational example of the injection level control of the control unit.
Figure 10:
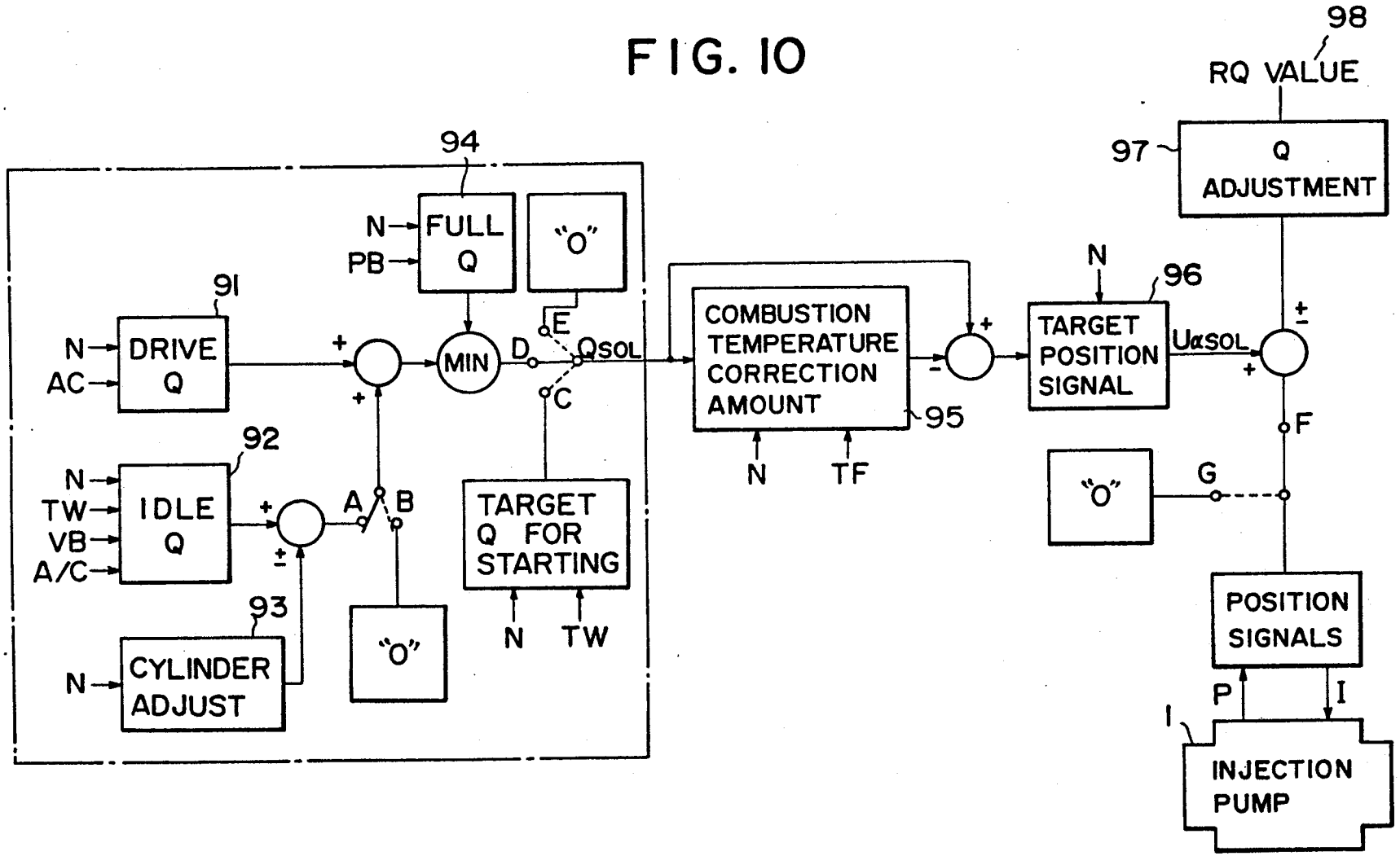
FIG. 10 is a block diagram of the fuel-injection control mechanism.

FIG. is a flow chart of an example of the Q adjustment correction process, which is referred to in FIG. 9 and FIG. 10.

DETAILED DESCRIPTION OF THE PREFERRED EMBODIMENT

An embodiment of the present invention will be explained below with reference to the accompanying figures.

Figure 1:
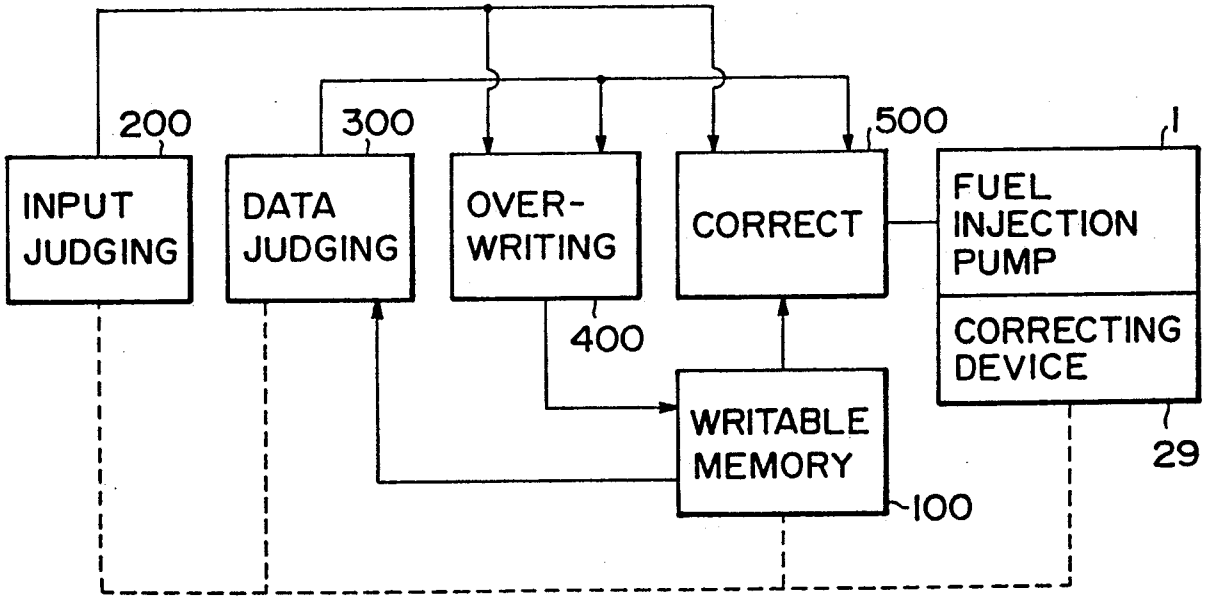
FIG. 1 is a block diagram of the electronic fuel-injection device of the present invention.
Figure 2:
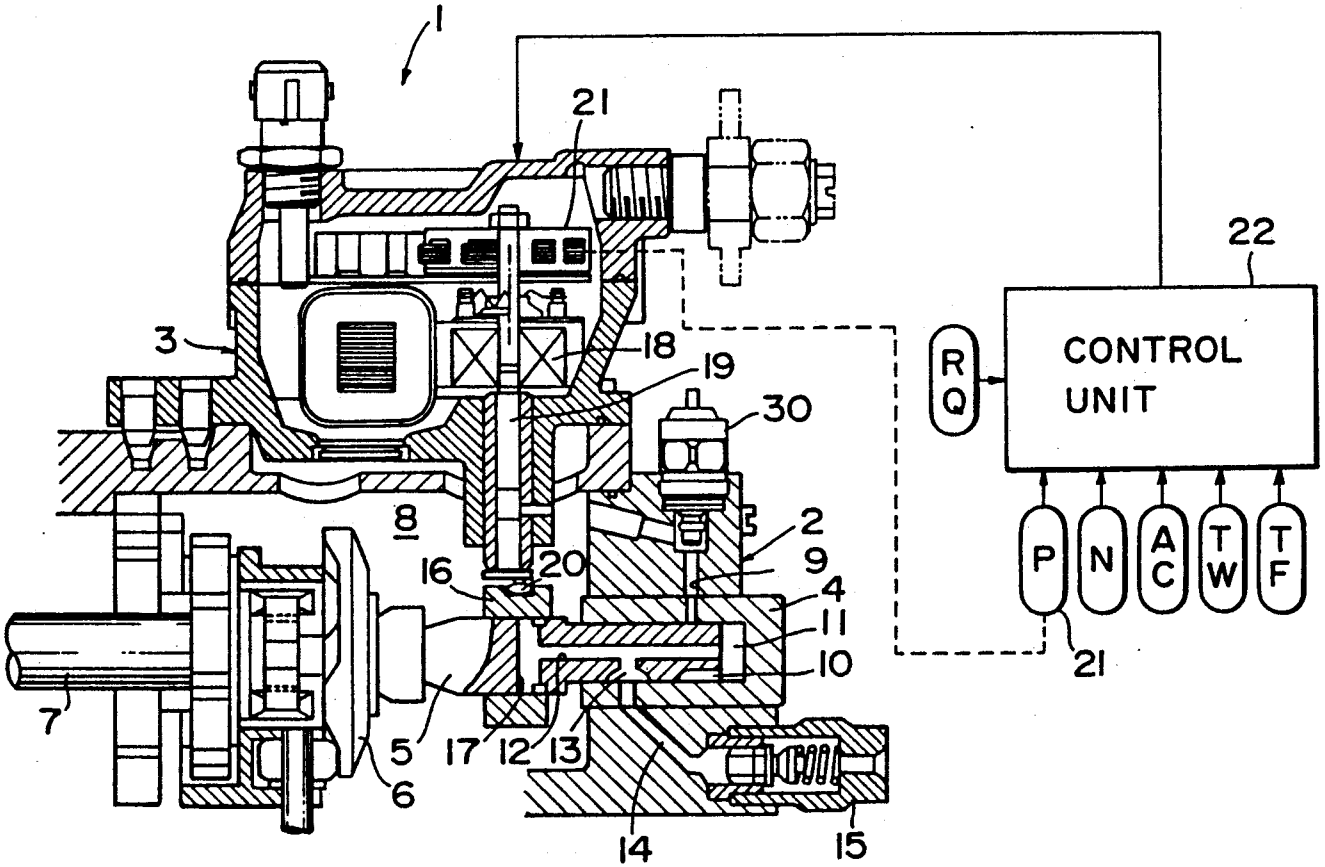
FIG. 2 is a schematic diagram of one embodiment of the electronic fuel-injection device of the present invention.

FIG. 2 illustrates part of a fuel injection pump 1. The fuel injection pump I has a pump body 2, and an actuator 3 known as an electrical governor (GE) mounted on the pump body 2.

The pump body 2 also has a plunger 5 movable within a plunger barrel 4. A cam disk 6 is fixed to the base of plunger 5. Driving shaft 7 rotates the cam disk 6 and plunger 5 whereupon the plunger 5 undergoes both reciprocating movement to pump fuel in and out and rotation to distribute the fuel. As shown in the figure, when plunger 5 is moved to the left, the fuel, which has been supplied to a fuel chamber 8 within the injection pump, is supplied through a pump-in groove 10 to a pumping chamber 11 defined by the plunger barrel 4 and plunger 5. The pump-in groove 10 extends in the axial direction of the plunger 5 to the extent of the end of a pump-in port 9. When the plunger 5 is moved to the right, pumping-in port 9 and pumping-in groove 10 are out of communication. Thus, during a fuel injection stroke of the plunger, fuel is compressed in pumping chamber 11 and thus supplied through a passage 12 in the plunger and a distribution port 13 to an injection nozzle of an injection (relief) valve 15. The fuel is thus injected into the engine.

A control sleeve 16 (adjusting member) extends around that part of the plunger 5 which projects from plunger barrel 4 into the fuel chamber 8, and the plunger 5 moves relative to sleeve 16. When a cut-off port 17 is separated from the sleeve 16 and is opened to chamber 8, the compressed fuel flows into fuel chamber 8. At this point, the fuel supply to the injection nozzle is stopped, and the injection is thus completed. By regulating the position of control sleeve 16 (adjusting member) relative to the plunger 5, the effective stroke of the plunger, in other words, the amount of fuel to be injected (level of injection), can be controlled. The farther control sleeve 16 is positioned to the left, the lower the level of injection is, as shown in the figure.

A rotor 18 of the actuator is connected to a shaft 19. A ball 20 is in turn fixed to the end of shaft 19. This ball 20 is positioned eccentrically with respect to shaft 19, and is engaged with the control sleeve 16 so as to move the control sleeve 16 in the axial direction of the plunger 5 upon rotation of rotor 18.

A position sensor 21 is provided on the top of actuator 3. The position sensor 21 detects the position of control sleeve 16 which indicates the rotational position (angle) of rotor 18 (an actual driving position of the actuator). Actual position signals P are sent from this position sensor 21 to a control unit 22.

The control unit 22 is operatively connected to the injection pump via a suitable electronic connector, and it comprises: a driving circuit driving the aforementioned actuator 3, a microcomputer controlling this driving circuit, and an input circuit by which signals are input to the microcomputer. The input circuit of the control unit 22 inputs the following signals, other than the signals from the aforementioned position sensor 21, to the microcomputer: accelerator position signals AC indicating a level of acceleration, engine rotation speed signals N indicating an engine rotation speed, water temperature signals TW indicating the temperature of engine coolant, fuel temperature signals TF indicating the fuel temperature, and signals from a Q adjustment resistor (RQ) which will be explained later. These signals are processed by the microcomputer which drives and controls the aforementioned actuator 3 via the driving circuit.

In FIG. 2, only the key components controlling the injection are illustrated, and other components, which are exactly the same as those used in conventional pumps, are omitted from the illustration.

The following is an explanation of the position adjustment carried out when securing the actuator to the injection pump. First, the actuator (GE) 3 is tentatively secured to pump 2 with a bolt. Electrical current is supplied to the GE, and the rotor 18 is set at a prescribed rotational position (angle of rotation).

Subsequently, air is supplied under pressure to the plunger 5, and the flow rate thereof through the plunger 3 is measured. The GE is positioned on pump 2 by shifting it relative to pump 2 until the measured flow rate coincides with a prescribed reference flow rate. When this occurs, the bolt is firmly tightened to secure the actuator 3 to the pump 2.

Because air pressure is used in place of fuel when performing the aforementioned position adjustment of the GE, the adjustment cannot be effected with a high degree of accuracy. This operation is thus only a rough adjustment to ensure accuracy only to a certain extent. To obtain a high degree of accuracy, the position of the GE needs to be more finely adjusted, but this requires an enormous effort. The adjustment resistor (Q adjustment resistor) of the present invention eliminates the need to make such a physical fine adjustment in relative position between the pump and actuator.

Figure 3:
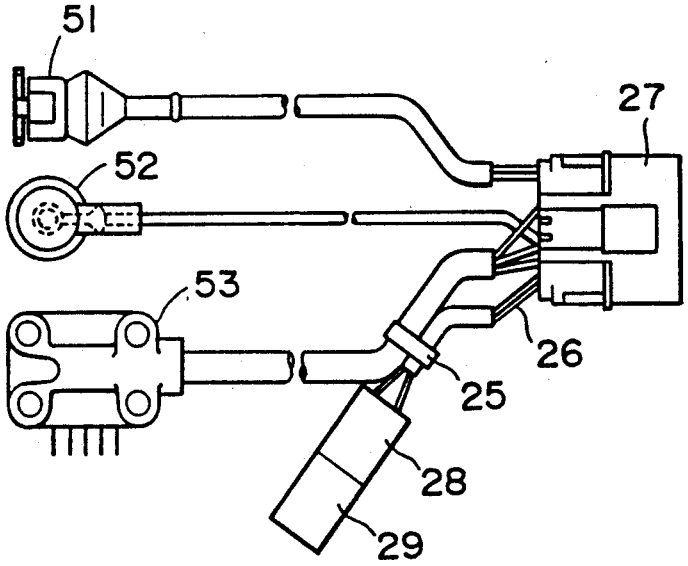
FIG. 3 is a plan view of a connector used in the fuel-injection device.

As shown in FIG. 3, a connector 28 is connected via lead wires 26 to a universal connector 27 for the control unit 22, where all the control mechanisms from the injection pump 1 are gathered. The lead wires 26 are in turn fastened to a harness and band 25. The Q adjustment resistor 29 is engaged with the connector 28. Thus, FIG. 3 also depicts a TCV connector 51 for connecting a timing control value to universal connector 27, a FCV connector 52 for connecting the fuel cut valve 30 shown in FIG. 2 to the universal connector 27, and a GE connector 53 for connecting the actuator (GE) 3 shown in FIG. 2 to the universal connector 27.

The following will describe the control of injection pump 1 with signals produced by the control unit 22 after the actuator 3 has been completely secured to the injection pump 1.

Figure 4:
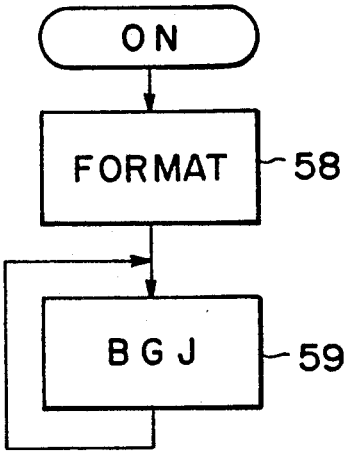
FIG. 4 is a flow chart of the basic process performed by the control unit of the fuel-injection device.
Figure 5:
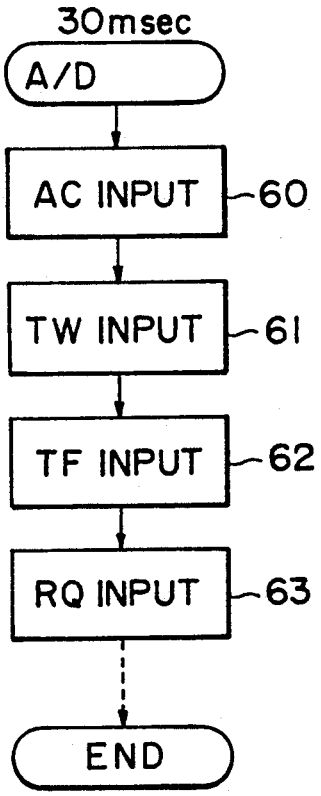
FIG. 5 is a flow chart of the signal-input process performed by the control unit.

FIG. 4 shows the basic processes carried out by the control unit 22. Control unit 22, upon ignition, is formatted (Step 58), and subsequently, it repeats various background jobs (Step 59). In this step (Step 59), an A/D input process shown in FIG. 5 is executed every 30 msec. As shown in the flow chart in FIG. 9, the fuel injection control is put into operation by the interrupt of prescribed pulses (TDC), which are generated as the engine rotates.

The A/D process mentioned here includes: converting the accelerator position signals (AC), water temperature signals (TW), fuel temperature signals (TF), and the signals from the Q adjustment resistor (RQ) into digital signals, and inputting these signals to the microcomputer (Step 60–Step 63). The input of the signals (step 63) from the Q adjustment resistor is shown in FIG. 6.

Figure 6:
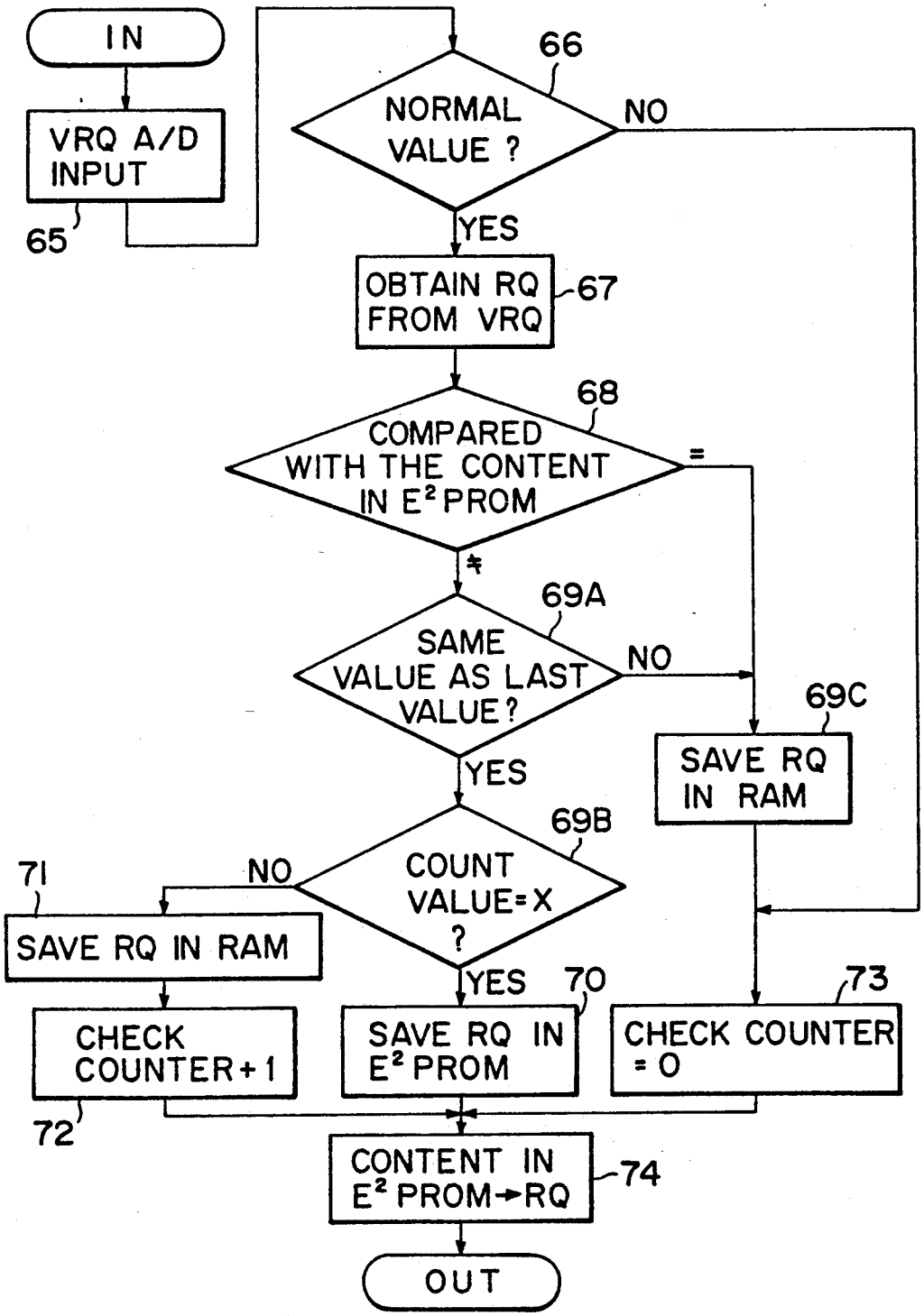
FIG. 6 is a flow chart of a specific example of the RQ input, which is one of the signal-input processes shown in FIG. 5.

In Step 65 shown in FIG. 6, the voltage (VRQ) impressed between both terminals of the Q adjustment resistor 29 is A/D converted. In the subsequent step, Step 66, this VRQ is compared with a normal voltage value range which has preliminarily been stored in an abnormality judging data region of a ROM of the input circuit.

These steps are carried out to determine whether there has been a disconnection of the lead wires 26 connecting the Q adjustment resistor 29 to connector 27, or whether the Q adjustment resistor 29 has been damaged to the extent that a short circuit is present. If either of these incidents have occurred, the signal from the Q adjustment resistor is so abnormal that the VRQ value will not agree with the normal stored voltage value range.

Figures 7, 8:
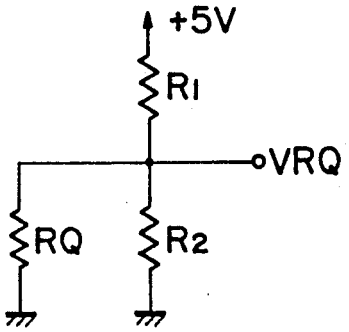
FIG. 7 is a circuit diagram of the circuit which outputs the signal (VRQ) from the Q adjustment resistor.
FIG. 8 is a table used to compute Q adjustment resistor (RQ) from VRQ.

More specifically, regarding the method of judging whether there is an abnormality, as shown in FIG. 7, two resistors (R1, R2) are connected in series and to a constant power source (5 V). One of the resistors (R2) is grounded and is connected in parallel with the RQ. A disconnection of the lead wires 26 has occurred if the value of VRQ output from R1 and R2 satisfies Formula 1, and a short circuit has occurred if it satisfies Formula 2. In any other case, the VRQ output is judged as normal.

Formula 1

$$VRZ \geqq 5 \times R2/(R1+R2)+\alpha(V)$$

Formula 2

$$VRQ \leqq O+\beta(V)$$

In the formulae, $\alpha$ and $\beta$ each represent a constant.

Returning to FIG. 6, if the VRQ is judged a normal value in Step 66, the process proceeds to Step 67. In this step, the value of the Q adjustment resistor (RQ) is computed based on the value of VRQ, using, for example, the lookup table shown in FIG. 8. Since the value VRQ must fall within the range noted above, in FIG. 8 the following relations hold: $5 \times R2/(R1+R2)+\alpha > VRQ1$, and $O+\beta < VRQ13$.

In the subsequent step, Step 68, an RQ value previously stored in an electrically programmable readable and writable memory ($E^2PROM$) is compared with the RQ value obtained in the aforementioned Step 67.

When the VRQ value is judged as an abnormal value in Step 66, or when the value stored in the $E^2PROM$ is judged, in Step 68, as equal to the RQ value obtained from the table in Step 67, the process proceeds to Step 73. Here, a check counter is reset to 0, and in Step 74, the value stored in the $E^2PROM$ is defined as an RQ value. On the other hand, if, in Step 68, the value stored in the $E^2PROM$ is judged as different from the RQ value obtained from the table in Step 68 when the VRQ value is in the normal range, it may be necessary to store this new RQ value in the $E^2PROM$, since it is apparent that the Q adjustment resistor secured to the pump has been replaced by another Q adjustment resistor having a different resistance value.

In Steps 69A to 73, it is examined whether the RQ value obtained in Step 67 is the same value 10 consecutive times. If the value is judged as the same, this RQ value is stored in the $E^2PROM$ in Step 70.

More particularly, at Step 69A, the current RQ value is compared with a prior RQ value stored in a RAM. If the current RQ value is different, the process proceeds to Steps 69C and 73 where the current RQ value is stored in the RAM and the counter is set to zero. If the current and prior RQ values are the same, the process proceeds to Step 69B where the counter value is examined. If the counter value is less than X, the process proceeds to Steps 71 and 72 where the current RQ value is stored in the RAM and the counter is incremented by one. The process then proceeds to Step 74 where the RQ value previously stored in the $E^2PROM$ is read and used to effect the fuel injection adjustment. If the counter value instead equals X (for example, where the RQ value is the same for 10 consecutive cycles), the current RQ value is overwritten in the E²PROM at Step 70 and then read at Step 74 to effect the fuel injection adjustment.

If the VRQ value is judged as abnormal, this data is stored in the memory, and will be displayed by a specific means when the abnormality is diagnosed.

Reference is now made to the flow chart of FIG. 9 and the functional block diagram of FIG. 10 to explain the actual fuel injection control. In Step 75, the target injection level is computed as follows.

The microcomputer of the control unit 22 computes the injection level for driving (drive Q) 91 from the injection characteristics for ordinary driving (which have been preliminarily stored in a ROM as map data) based on the engine rotation speed N and the accelerating position signals AC. The control unit 22 also computes the injection level for idling (idle Q) 92, which is to keep a target idle rotation number constant even under a load change during idling, on the basis of parameters indicating changes in conditions during idling (engine rotation number N, engine cooling water temperature TW, battery voltage VB, and an/off of the air conditional switch A/C).

Idle Q is adjusted, taking into consideration that an amount of fuel to be injected varies according to each cylinder. The difference in characteristics of each cylinder is determined according to the engine rotation speed N as depicted in block 93 of FIG. 10.

When the engine rotation speed N is below a prescribed speed, the adjusted idle Q is added to the aforementioned drive Q (switch position A), but when the engine rotation speed N exceeds the prescribed speed, the adjusted idle Q is not added to drive Q (switch position B).

On the basis of the engine rotation speed N and a boos pressure PB, a maximum injection level (full Q) 94 required for maximum engine performance is computed. Then, the initial target injection level computed in the aforementioned steps is compared with this full Q, and the smaller of the two is selected, so that the target injection level will not exceed the full Q.

The target injection level explained above is used for ordinary driving (switch position D). When the engine is being started, a target injection level which facilitates the starting of the engine is computed from prescribed data denoting characteristics of engine rotation speed N and engine coolant temperature TW (switch position C). Alternately, when the engine rotation speed N is 0, or an abnormality has occurred, the target injection level is not generated (switch position E). Following the target injection level ($Q_{sol}$) computation, a combustion temperature correction amount 95 is computed in Step 76. This combustion temperature correction corrects the aforementioned target injection level on the basis of engine rotation speed N and combustion temperature TF, since the actual injection level decreases, as fuel concentration decreases according to the rise in combustion temperature. Subsequently, the process proceeds to Step 77, where the target injection level is converted to target position signals $U_{asol}$ based on the engine rotation speed N as shown in block 96 of FIG. 10..

In the next step 78, Q adjustment correction 97 of the target position signals is effected based on the RQ value 98 retrieved from the E²PROM in the aforementioned Step 74. Subsequently, in Step 79, the corrected target position signals are supplied to the driving circuit (switch position F). However, if the engine rotation speed N is 0, or an abnormality has occurred, the corrected target position signals are not supplied to the driving circuit (switch position G). The driving circuit, while receiving feedback signals P from the aforementioned position sensor, supplies current I to the actuator, so that the control sleeve 16 will be actually positioned at the corrected target position. The driving circuit also controls the rotational angle of the rotor 18.

Figure 11:
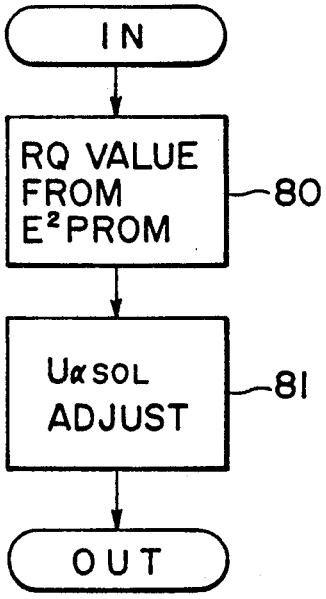

In the aforementioned Q adjustment correction process, as shown in FIG. 11, the correction value (ΔU), which makes the sleeve position voltage agree with reference position voltage, is computed, based on the RQ value retrieved from E²PROM in Step 80. In the next step, Step 81, (ΔU) is added to $U_{asol}$, and a new $U_{asol}$ is computed.

According to the aforementioned control, because the conditions under which the signals are input from the Q adjustment resistor 29 are constantly checked, and because injection characteristics of the injection pump 1 are corrected on the basis of the Q adjustment data stored in the E²PROM, an accurate correction can be made even when the signal input from Q adjustment resistor 29 is abnormal, in the same way as when the signal input is normal.

Moreover, when the Q adjustment resistor is replaced when the fuel injection pump 1 characteristics are adjusted, new data from the Q adjustment resistor is input in the E²PROM, upon each replacement of the Q adjustment resistor. Therefore, the most appropriate Q adjustment resistor can be selected by trial and error when the injection pump is assembled.

It goes without saying that the aforementioned technical content of the present invention can be revised or changed to a great extent. For example, in the aforementioned application example, a VE-type fuel injection pump was described, bu the aforementioned method of correcting and controlling the characteristics of the injection level can be used for a line-type fuel injection pump. It is conceivable to implement the present invention in various forms which are not specifically described above. All such various forms are seen to be within the true spirit and scope of the present invention defined by the appended claims.

What is claimed is:

1. An electronic fuel-injection device comprising:

a fuel-injection pump having an adjusting member, a fuel-injection level of said fuel-injection pump being established by a position of said adjusting member;

an actuator drivable to position said adjusting member to control the fuel-injection level of said fuel injection pump;

a correcting device having a physical quantity indicative of a correction value;

a readable and writable memory for storing an actuator correction value, the actuator correction value indicative of a difference between an actual fuel-injection level and a reference fuel injection level of said fuel injection pump; and, control means for (a) detecting the physical quantity of said correcting device, (b) determining whether the thus detected physical quantity is within normal parameters, (c) comparing a first correction value indicated by the detected physical quantity with a second correction value previously stored in said memory as the actuator correction value, (d) overwriting said second correction value with said first correction value in said memory when both the detected physical quantity is within normal parameters and the first correction value is different than the second correction value, whereby the first correction value becomes the actuator correction value stored in said memory, (e) reading the actuator correction value from said memory, and (f) driving said actuator to compensate for the difference in the actual and reference fuel injection levels using the thus read actuator correction value.

2. An electronic fuel-injection device as recited in claim 1, wherein said fuel injection pump further includes a fuel chamber, a plunger barrel, a plunger extending from said fuel chamber into said plunger barrel and slidably received by said plunger barrel so as to be reciprocatable, said plunger and said plunger barrel defining a pumping chamber defined within said barrel, a pump-in port open to said fuel chamber and to the interior of said plunger barrel so as to place said fuel chamber and said pumping chamber in communication when said plunger is at a predetermined axial position within said barrel, and a fuel injection valve, said plunger defining a passage therein which is open to said pumping chamber and to the periphery of that portion of the plunger which is located in said fuel chamber and which passage also communicates with said fuel injection valve, and wherein said adjusting member comprises a control sleeve extending around the plunger within said fuel chamber so as to block said passage from communicating with said fuel chamber over a stroke of said plunger that is dependent upon the position of said sleeve relative to said plunger whereby during said stroke said plunger pumps fuel from said pumping chamber and to said fuel injection valve under pressure as said passage is blocked from communicating with said fuel chamber by said control sleeve, and said actuator being operatively connected to said control sleeve so as to position said sleeve axially of said plunger thereby establishing said stroke.

3. An electronic fuel-injection device as recited in claim 2, wherein said actuator includes a rotor operatively connected to said control means so as to be driven thereby, and a shaft rotatably driven by said rotor about a longitudinal axis of said shaft, said shaft connected to said control sleeve at a location which is offset from said longitudinal axis whereby rotation of said shaft is transmitted into axial movement of said sleeve relative to said plunger.

4. An electronic fuel-injection device as recited in claim 1, and further comprising a universal connector connected to said control means, said actuator being operatively connected to said control means via said universal connector, and a second connector connected to said universal connector via lead wires, said correcting device being detachably connected to said second connector.

5. An electronic fuel-injection device as recited in claim 1, wherein said correcting device is a resistor.

6. An electronic fuel-injection device as recited in claim 1, wherein said correcting device is a resistor coupled in parallel to a first grounded resistive element and in series to another resistive element connected to a power source, and wherein the physical quantity of said correcting device is detected in accordance with a voltage across said correcting device.

7. An electronic fuel-injection device as recited in claim 1, wherein the physical quantity of said correction device falls within a plurality of ranges extending from a maximum value to a minimum value.

8. An electronic fuel-injection device as recited in claim 7, wherein the physical quantity of said correction device falls within 13 predetermined ranges.

9. An electronic fuel-injection device as recited in claim 1, wherein said readable and writable memory is an $E^2$PROM.

10. An electronic fuel-injection device as recited in claim 1, wherein said control means operates at regular time intervals.

11. An electronic fuel-injection device as claimed in claim 10, wherein said control means operatives at every 30 msec.

12. An electronic fuel-injection device as recited in claim 1, wherein said control means includes means for determining whether a voltage across said correction device is within a predetermined range.

13. An electronic fuel-injection device as recited in claim 1, wherein said control means carries out said overwriting only after confirming that the first correction value indicated by the detected physical quantity of said correcting device is the same a predetermined plurality of times in succession.

14. An electronic fuel-injection device as recited in claim 1, wherein said control means is responsive to a pulse signal generated as an engine rotates, and wherein said control means repetitively detects the physical quantity of said correcting device at a timing corresponding to said pulse signal.

15. An electronic fuel injection device as recited in claim 1, wherein said control means include means for applying position drive signals to said actuator and means for adjusting said position drive signals based on said actuator correction value.

* * * * *